US005505458A

United States Patent [19]

Blokh et al.

[11] Patent Number: 5,505,458

[45] Date of Patent: Apr. 9, 1996

[54] CARD GAME

[76] Inventors: Leonid Blokh, 2925 W. 5th St. #19A, Brooklyn, N.Y. 11224-3978; George Spector, 233 Broadway Rm. 702, New York, N.Y. 10279

[21] Appl. No.: 382,445

[22] Filed: Feb. 2, 1995

[51] Int. Cl.[6] ..... A63F 1/10; A63F 1/00

[52] U.S. Cl. ..... 273/299; 273/148 A; 273/293

[58] Field of Search ..... 273/299, 272, 273/148 A, 293

[56] References Cited

U.S. PATENT DOCUMENTS 4,014,547 3/1977 Gomez et al. ..... 273/243

4,281,835 8/1981 Seiden ..... 273/299

4,316,612 2/1982 Harder ..... 273/272

4,669,732 6/1987 Zebrowski et al. ..... 273/148 A

*Primary Examiner*—Benjamin H. Layno

[57] ABSTRACT

An educational card game designed to develope mathematical abilities, to perform various combined operations by dealing cards to each player and selecting at random a card designating the number that must be calculated from the card numbers of each players hand; wherein a timing device is provided to deal out the cards.

3 Claims, 1 Drawing Sheet

CARD GAME

BACKGROUND OF THE INVENTION

The instant invention relates generally to games and more specifically it relates to an educational, mathematical card game; that involves use of various mathematical operations to calculate a specific number on a randomly picked card.

Numerous games have been provided in prior art that are adapted to utilize playing cards to carry out arithmetic operations which would not be suitable for the purpose of the present invention as described hereinbelow which also involves a novel means for card selection.

SUMMARY OF THE INVENTION

A principle object of the present invention is to provide an educational card game that allows each player to use mathematical operations of adding, subtracting, multiplying, dividing, extracting roots, logarithmic computations, etc.

Another object is to provide an educational card game that uses a deck of specially numbered cards that can be played by any number of people of any age and level of mathematical proficiency.

An additional object is to provide an educational card game that contains a timing device that is activated by a calculate number card when removed therefrom, which makes the game more interesting by imposing pressure of time on each player.

A further object is to provide an educational card game that is economical in cost to manufacture.

A still further object is to provide an educational card game that is simple and easy to use which developes logical skills and ability to perceive maximum mathematical combinations.

Further objects of the invention will appear as the description proceeds.

To the accomplishment of the above and related objects, this invention may be embodied in the form illustrated in the accompanying drawings, attention being called to the fact however, that the drawings are illustrative only and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
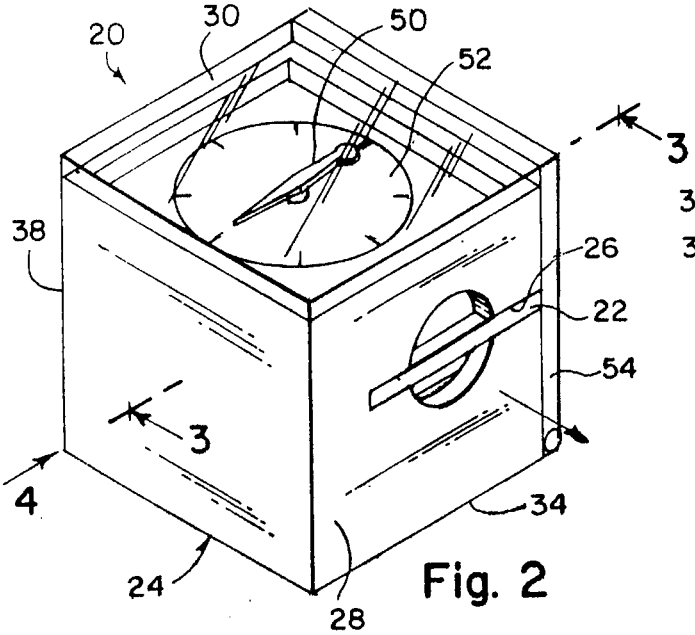
FIG. 2 is a perspective view of a timing device used in playing the game.
Figure 4:
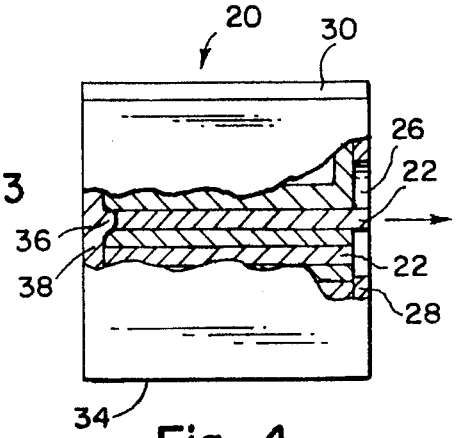
FIG. 4 is a side view with parts broken away as indicated by arrow 3 in FIG. 1 showing how the top calculate number card enters the slot in the housing to be manually pulled out to set the arrow indicator.
Figure 5:
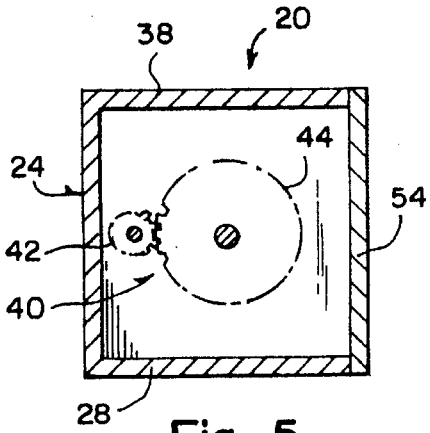
FIG. 5 is a cross sectional view taken along line 4—4 in FIG. 3 showing the gear wheel and time gear in engagement.
Figure 3:
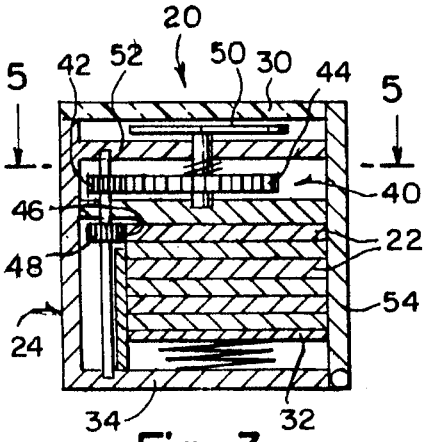
FIG. 3 is a cross sectional view taken along line 2—2 in FIG. 2.
Figure 6:
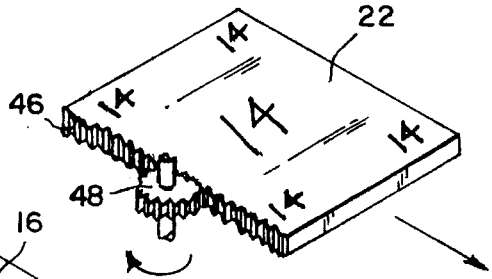
FIG. 6 is a perspective view of the top calculate number card and card gear in engagement.
Figure 1:
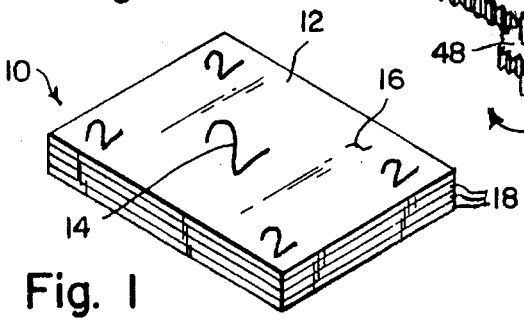
FIG. 1 is a perspective view of a deck of cards used in playing the game.

Turning now descriptively to the drawings, in which similar reference characters denote similar elements throughout the several views, FIG. 1 illustrates a deck of cards 10 used in playing the educational card game. The uppermost card 12 carries numerical indicia 14 on the uppermost lateral surface 16. Other cards, shown below card 12, carries similar indicia on their uppermost surfaces, comprising the remaining cards 18 of the deck 10. The numerical indicia 14 can be whole, fractions, negative and/or positive.

The game is played as follows: A first player receives several cards (three or more) from the deck 10 with certain numerical indicia 14 upon them to form a hand. Another player gives the first player a calculate number card or the first player can take the calculate number card from the deck 10. A player by using a maximum of the cards in his hand must calculate via a mathematical operation, such as adding, subtracting, multiplying, dividing, root extraction, etc., the number on the calculate number card.

For example, the first player receives five cards from the deck 10 with the numerical indicia 14 being "2", "5", "5", "7" and "11" for his hand. The calculate number card has the numerical indicia "14" upon it which the first player must now calculate from his hand.

He can use three cards: "2", "5" and "7", (2+5+7=14). He can use four cards: "2", "5", "5" and "11", $$\left(\frac{5}{5} = 1 + 11 + 2 = 14\right).$$

He can use five cards: "2", "5", "5", "7" and "11" (11×7=77, 5+2=7, 77−7=70 and 70÷5=14. The object of the game is to use as many cards as possible. The player using the most cards wins.

The educational card game can be played by any number of people or it can be played by a single player. Calculation may be performed with or without a calculator.

To make the educational card game more interesting, a timing device 20 shown in FIGS. 2 thru 6 is provided. It imposes pressure of time on each player such as would be when taking an examination. The timing device 20 is activated by a calculate number card 22 that is manually pulled out from the timing device.

The timing device 20 consists of a box-like housing 24 that has a finger grip slot 26 in one side wall 28 and a transparent top 30. A spring biased platform 32 is within the housing 24 and located on bottom floor 34 to hold a plurality of the calculate number cards 22.

A cam 36 is formed within the housing 24 on another side wall 38 opposite the finger grip slot 26 so that the top calculate number card 22 will be properly positioned at the finger grip slot.

A gear assembly 40, being a gear wheel 42 and a time gear 44, is rotatably mounted within the housing 24 above the calculate number cards 22. Each calculate number card has a rack 46 formed on one edge.

A pinion 48 is rotatably mounted in the housing 24 to engage with the rack 46 on uppermost calculate number card 22. The pinion 48 drives the gear assembly 40 when the uppermost calculate number card is manually pulled out through the finger grip slot 26 in the housing 24.

A spring biased arrow indicator 50 with dial 52 is mounted within the transparent top 30 of the housing 24. The arrow indicator 50 is driven by the gear assembly 40 to set time on the dial 52.

A spring biased door 54 is mounted to the housing 24 so that access within the housing is possible to reload the calculate number cards 22 and adjust the gear assembly 40 when needed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An educational card game which comprises a deck of cards, each said card bearing on uppermost surface numerical indicia, whereby a player receives several said cards from said deck with certain said numerical indicia upon them to form a hand and another said card to be used as a calculate number card, said player uses as many of said cards as possible in said hand to calculate via a mathematical operation, such as adding, substracting, multiplying and dividing the number on said calculate number card, wherein the winner uses the maximum number of cards; further comprising card dispensing means for holding said calculate number card and imposing a time limit as a player is taking a calculate card, from said card dispenser wherein said card dispensing means includes a timing device activated by said calculate number card being manually pulled out from said timing device.

2. An educational card game as recited in claim 1, wherein said timing device comprises:

a) a box-like housing having a finger grip slot on one side wall and a transparent top;

b) a spring biased platform within said housing and located on bottom floor to hold a plurality of said calculate number cards;

c) a cam formed within said housing on another side wall opposite said finger grip slot so that said top calculate number card will be properly positioned at said finger grip slot;

d) a gear assembly rotatably mounted within said housing above said calculate number cards;

e) each said calculate number card having a rack formed on one edge;

f) a pinion rotatably mounted in said housing to engage with said rack on uppermost calculate number card for a portion of the distance moved by the card during withdrawal, said pinion drives said gear assembly when said uppermost calculate number card is manually pulled out through said finger grip slot in said housing and g) a spring biased arrow indicator with dial mounted within said transparent top of said housing, said arrow indicator driven by said gear assembly to set time on said dial.

3. An educational card game as recited in claim 2, further comprising a spring biased door mounted to said housing so that access within said housing is possible to reload said calculate number cards and adjust said gear assembly when needed.

* * * * *